US007052098B1

(12) United States Patent
Greiner

(10) Patent No.: US 7,052,098 B1
(45) **Date of Patent: *May 30, 2006**

(54) JEWELRY CHEST AND BOX WITH SLIDABLE FEATURES

(76) Inventor: Lori Greiner, 1301 Dearborn Pkwy., Suite 402, Chicago, IL (US) 60610

( * ) Notice: Subject to any disclaimer, the term of this patent is extended or adjusted under 35 U.S.C. 154(b) by 0 days.

This patent is subject to a terminal disclaimer.

(21) Appl. No.: 10/361,550

(22) Filed: Feb. 10, 2003

Related U.S. Application Data

(63) Continuation of application No. 09/728,505, filed on Dec. 1, 2000, now Pat. No. 6,595,609.

(60) Provisional application No. 60/206,177, filed on May 22, 2000.

(51) Int. Cl.
*A47B 96/16* (2006.01)

(52) U.S. Cl. ..... 312/321.5; 312/309; 206/6.1

(58) Field of Classification Search ..... 312/227, 312/308, 309, 310, 300, 120, 123, 245, 294, 312/321.5, 351; 206/6.1
See application file for complete search history.

(56) References Cited

U.S. PATENT DOCUMENTS

| | | | | |
|---|---|---|---|---|
| 1,600,830 | A | 9/1926 | Lewis | |
| 1,610,146 | A * | 12/1926 | Panzer | 190/109 |
| 2,513,150 | A | 6/1950 | Davis | |
| 2,663,608 | A | 12/1953 | Schauer | |
| 2,739,697 | A | 3/1956 | Kuddes | |
| 3,078,133 | A | 2/1963 | Schauer | |
| 3,639,022 | A | 2/1972 | Elmo | |
| 3,813,138 | A | 5/1974 | Doohan | |
| 3,876,271 | A | 4/1975 | Skirlock | |
| 3,930,702 | A | 1/1976 | Pichowicz | |
| 4,120,549 | A | 10/1978 | Bureau | |
| 4,239,308 | A | 12/1980 | Bradley | |
| 4,371,077 | A | 2/1983 | Solitt et al. | |
| 4,396,121 | A | 8/1983 | Lemmon | |
| 4,616,891 | A * | 10/1986 | Jantzen | 312/328 |
| 4,771,206 | A | 9/1988 | Taylor | |
| 4,811,996 | A | 3/1989 | Hansson | |
| 4,850,658 | A | 7/1989 | Sandor | |
| 4,854,656 | A | 8/1989 | O'Keefe | |
| 4,936,463 | A | 6/1990 | Tiramani | |
| 4,984,854 | A | 1/1991 | DeLavallade | |
| 5,108,162 | A | 4/1992 | Lund | |
| 5,117,971 | A | 6/1992 | Fisher | |
| 5,261,529 | A | 11/1993 | Holland | |
| 5,358,100 | A * | 10/1994 | Wolff | 206/749 |
| 5,411,139 | A | 5/1995 | Victory | |
| D361,430 | S | 8/1995 | Mohundro | |
| 5,484,092 | A | 1/1996 | Cheney | |
| 5,511,873 | A | 4/1996 | Mech | |

(Continued)

FOREIGN PATENT DOCUMENTS

| | | |
|---|---|---|
| DE | 19924969 A1 | 12/2000 |

(Continued)

*Primary Examiner*—James O. Hansen
(74) *Attorney, Agent, or Firm*—Fredrikson & Byron, P.A.

(57) ABSTRACT

A jewelry chest and box for storing jewelry having a plurality of compartments to store jewelry items of various configurations. The jewelry chest includes pivoting cabinets having earring stands that are slidably received in the cabinets. Pivoting trays have various compartments to hold jewelry items such as bracelets, rings and pins. The jewelry box has a bottom tray and an upper tray each having divided compartments. The upper tray is slidably mounted in the box and preferably can be removed from the box.

19 Claims, 11 Drawing Sheets

U.S. PATENT DOCUMENTS

| | | | | | |
|---|---|---|---|---|---|
| 5,558,418 | A | | 9/1996 | Lambright et al. | |
| 5,685,624 | A | | 11/1997 | Lee | |
| 5,690,401 | A | | 11/1997 | Franklin | |
| 5,692,605 | A | | 12/1997 | Lai | |
| 5,762,184 | A | * | 6/1998 | Greiner | 206/6.1 |
| 6,045,202 | A | | 4/2000 | Simon | |

FOREIGN PATENT DOCUMENTS

| | | | | |
|---|---|---|---|---|
| FR | 940540 | | | 12/1948 |
| GB | 287249 | | | 3/1928 |
| GB | 2205225 | A | | 12/1988 |
| GB | 2217298 | | * | 10/1989 |
| GB | 2 273 649 | A | | 6/1994 |
| GB | 2273649 | | * | 6/1994 |
| GB | 2345630 | | | 7/2000 |
| JP | 2000-197530 | | | 7/2000 |
| WO | WO 99/00005 | | | 1/1999 |

* cited by examiner

JEWELRY CHEST AND BOX WITH SLIDABLE FEATURES

RELATED APPLICATION

This is a continuation of application Ser. No. 09/728,505 filed Dec. 1, 2000 now U.S. Pat. No. 6,595,609.

The present application claims the priority of U.S. Provisional Patent Application Ser. No. 60/206,177, entitled "Jewelry Chest and Box with Slidable Features" filed May 22, 2000.

FIELD OF THE INVENTION

The present invention relates to a jewelry chest and box with unique slidable features. While several different kinds of jewelry chests and boxes are known, there is a need for a jewelry chest and box that are convenient to use and allow a user to easily view and select jewelry.

BACKGROUND OF THE INVENTION

One type of a known jewelry holder is in the form of a container with relatively high sides and back walls and a top that is hinged to the back wall to permit access into the container. Earring stands are fixed to the bottom of the container. A particular problem with this type of jewelry holder is that it is very difficult to insert and remove the jewelry from the stands because the side walls and hinged top limit the amount of space available.

Yet another type of jewelry holder proposes racks that slide into a box-like container having a single open side. Again, a problem with this type of jewelry holder is that because the racks are designed as an integral part of the box-like container when the racks are removed from the container, the racks cannot be placed on a horizontal surface without falling over. In addition, because there is only one open side, access to the jewelry located inside the container is limited.

U.S. Pat. No. 5,762,184, invented by the present inventor and hereby incorporated by reference discloses a jewelry holder with a plurality of movable earring stands that are positioned on a base. The base is in the form of a box with an open front that slidably receives drawer. The top of the base is provided with a plurality of grooves that slidably receive the earring stands. The stands include a pair of supports joined by a substantially horizontal cross-piece that has at least one aperture sized to receive a post or stem of an earring. The stands include a base that is sized to slidably fit within the grooves in the base. Alternatively, clip-on earrings may be directly clipped onto the crosspiece. The drawer is limited in the amount of jewelry it can store.

Thus, it is desirable to provide a jewelry chest that can hold a large amount of jewelry in an organized fashion that allows a user to have direct and easy access to the jewelry contained therein. In addition, it is desirable to provide a jewelry chest and box that makes visual inspection of the items contained therein easy. In addition, it is desirable to provide a jewelry chest and box that groups like items together.

DETAILED DESCRIPTION OF THE PREFERRED EMBODIMENTS

Figures 1, 3:
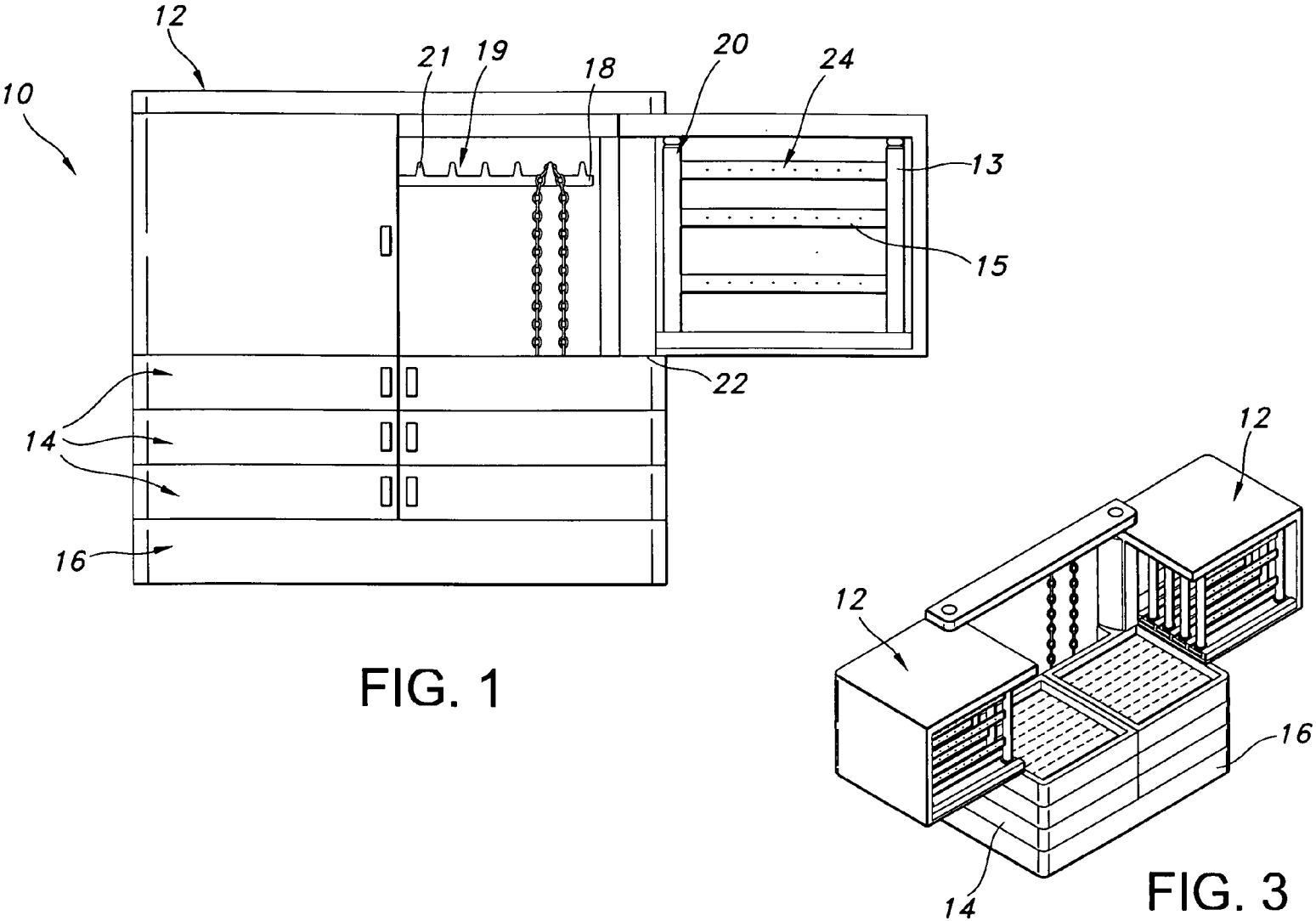
FIG. 1 is a front elevational view of a jewelry chest according to a first preferred embodiment of the present invention.
FIG. 3 is a perspective view of the jewelry chest shown in FIG. 1 with both doors open.
Figure 2:
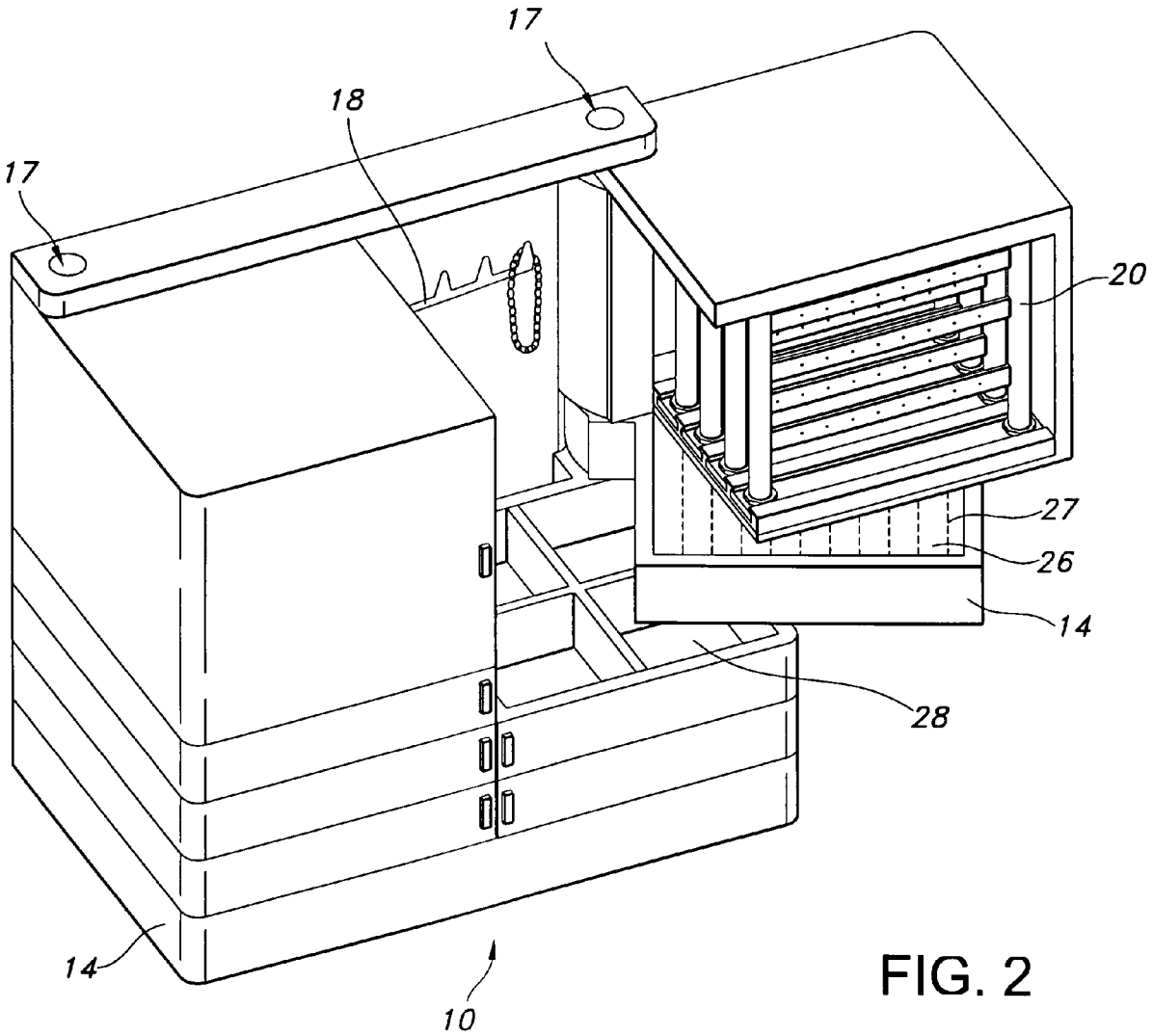
FIG. 2 is a perspective view of the jewelry chest shown in FIG. 1 with the door and a pivoting tray open.

FIG. 1 is a front elevational view of a jewelry chest according to a first preferred embodiment of the invention. The jewelry chest 10 has two doors 12, six pivoting trays 14 located underneath the two doors and a box 16 located underneath the pivoting trays 14. The jewelry chest 10 is shown with one of the doors 12 swung open. The jewelry chest 10 has a back wall 19 with a necklace rack 18 secured thereto. The necklace rack 18 has a plurality of hooks 21 on which necklaces can be hung. The doors 12 each form a cabinet as can be seen in FIGS. 2 and 3 in which a plurality of sliding earring stands 20 are mounted. More particularly, the sliding earring stands 20 can be slid out of the cabinet formed in the door 12. The sliding earring stands 20 are mounted in grooves/tracks 22 formed in the bottom of the door. U.S. Pat. No. 5,762,184 entitled "Jewelry Holder with at Least One Movable Stand", by the present inventor which is incorporated herein by reference, discloses sliding earring stands that are the same as those incorporated into the doors. The sliding earring stands 20 each have a plurality of crosspieces 24 formed extending between pillars 13. Each cross piece has a plurality of holes 15 in which pierced earrings can be mounted. In addition, clip on earrings can be mounted directly to the crosspiece 24. The sliding earring stands, when removed from the cabinet, are self-supporting.

FIG. 2 is a perspective view of the jewelry chest 10 shown in FIG. 1 with one of the front doors 12 open and one of the pivoting trays 14 pivoted open. From this view the plurality of sliding earring stands can be seen mounted in the door. The doors 12 and pivoting trays 14 are rotatably secured in the housing of the chest by hinges 17. The top pivoting tray 14 is shown swung open and has a ring section 26 formed therein. The ring section 26 is preferably a soft, foam-like material in which slits 27 are formed. The slits 27 accommodate rings so that they can be mounted therein. The second pivoting tray 14 located underneath the top pivoting tray is preferably designed to hold bracelets and pins. The bracelet and pin section 28 are formed by compartments as shown. While only one of the pivoting trays is shown swung open, all of the pivoting trays can swing open underneath the doors 12. FIG. 3 is a perspective view of the jewelry chest 10 shown in FIG. 1 with both doors 12 swung open. It can be seen that in each door a plurality of sliding earrings stands 20 are mounted. Of course, it will be appreciated that the location of the ring section and bracelet and pin section may be located in other trays than as illustrated or may be omitted altogether.

Figure 5:
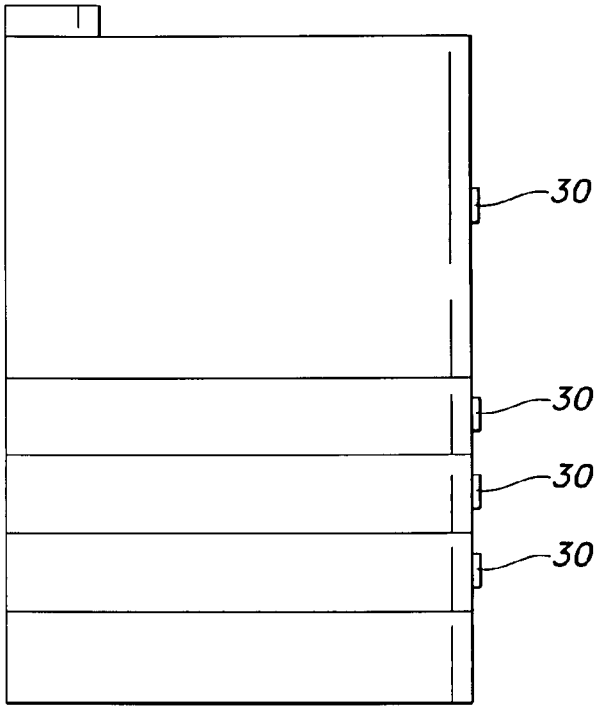
FIG. 5 is a side view of the jewelry chest shown in FIG. 1.
Figure 4:
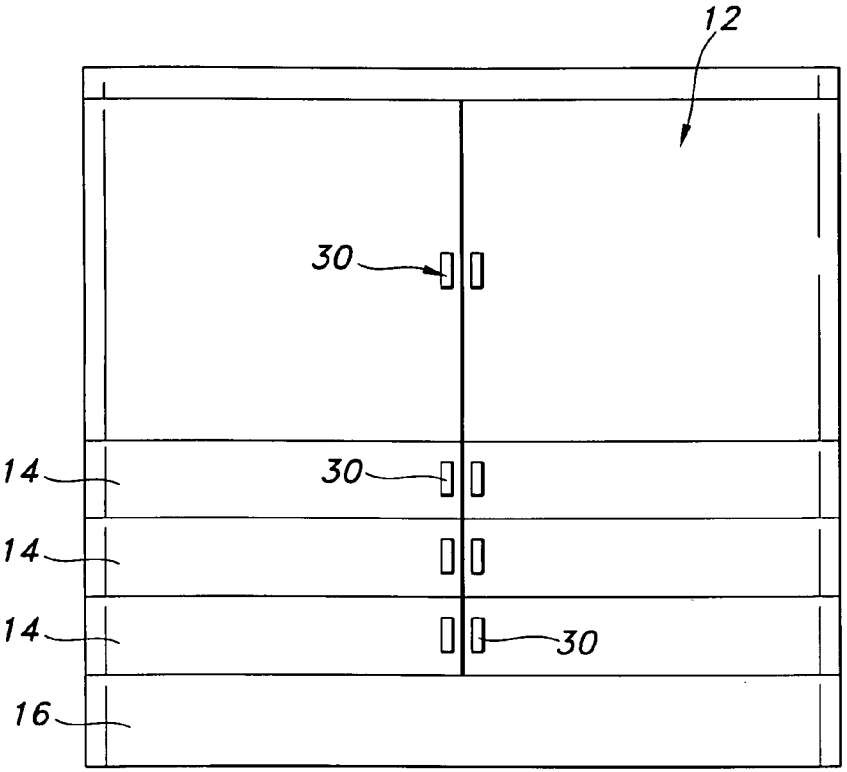
FIG. 4 is a front elevational view of the jewelry chest shown in FIG. 1 closed.

FIG. 4 is a front elevational view of the jewelry chest 10 shown in FIG. 1 with all the doors and pivoting trays closed. Handles 30 are formed on the doors and the pivoting trays to swing open or pivot the doors and trays. FIG. 5 is a side view of the jewelry chest 10 shown in FIG. 1.

Figure 6:
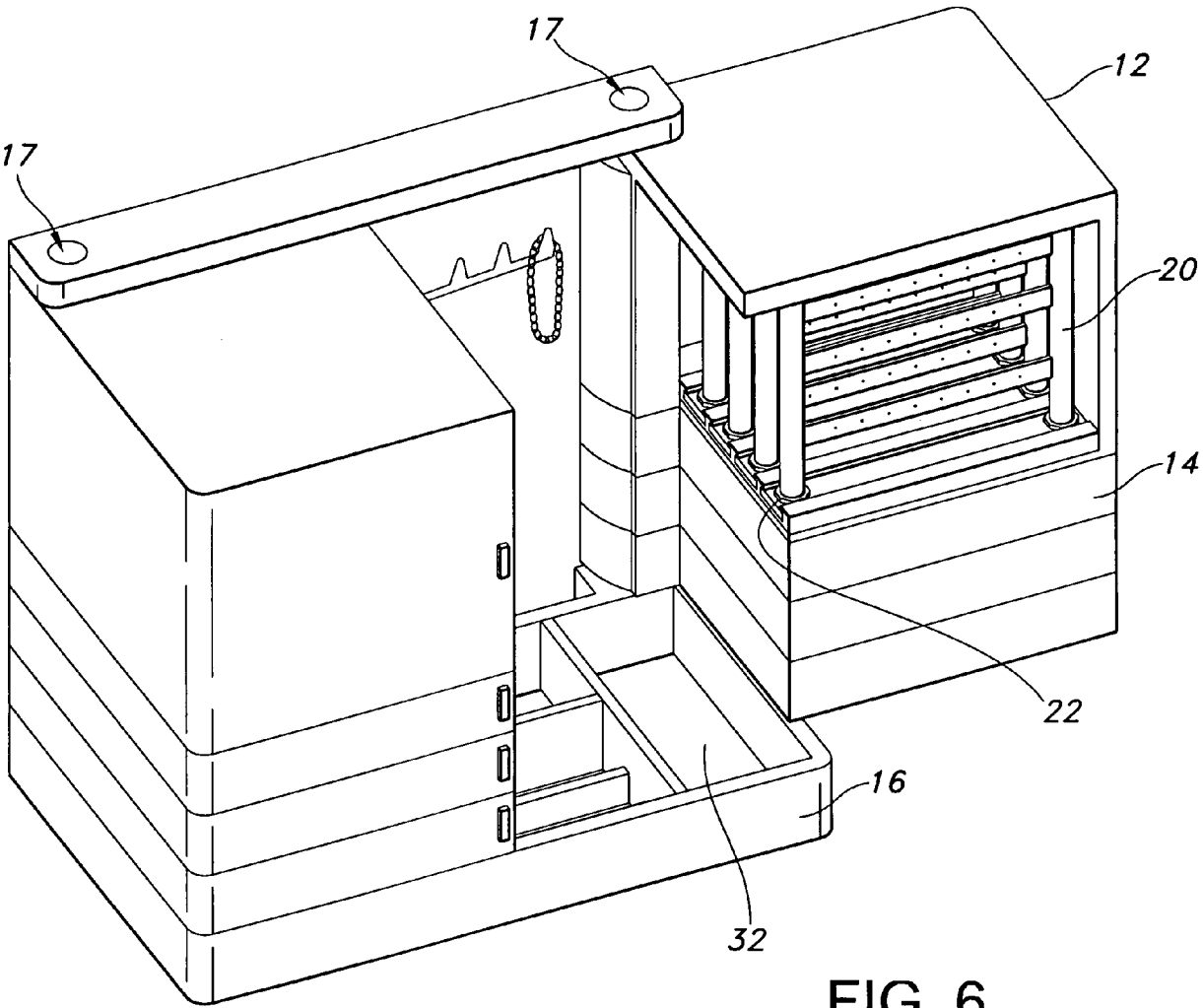
FIG. 6 is a perspective view of the jewelry chest shown in FIG. 1 with one door and all three pivoting trays open.
Figure 7:
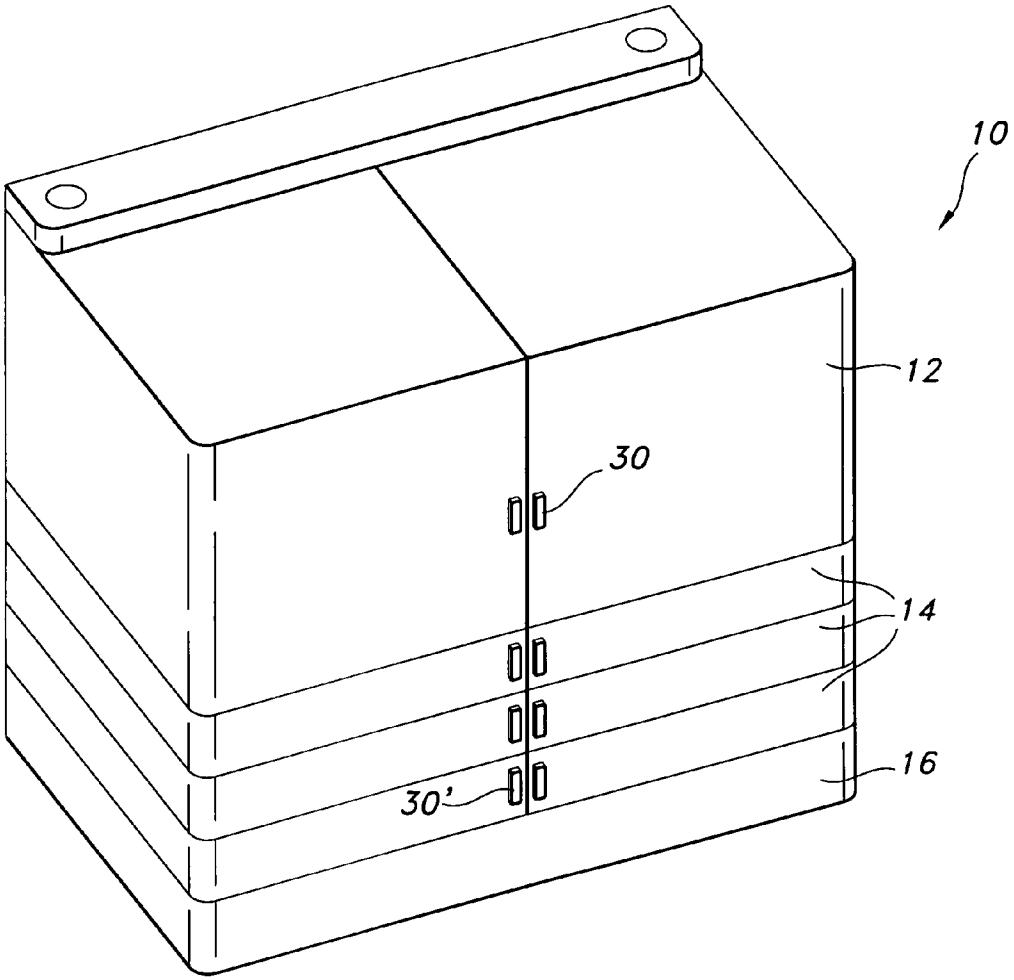
FIG. 7 is a perspective view of the jewelry chest shown in FIG. 1 closed.

FIG. 6 is a perspective view of the jewelry chest shown in FIG. 1 with one door and the three pivoting trays 14 located underneath the door 12 swung open. The box 16 located under the pivoting trays 14 has a plurality of compartments 32 formed therein which are designed to hold larger jewelry items, such as cuff links, large pins, large bracelets, etc. The walls and floors of the compartments of the jewelry chest are preferably lined with an anti-tarnish cloth 33, such as Glendale Polish Cloth, which is commercially available from Fifield Inc. of Hingham, Mass., or Silversmith's Cloth available from W. J. Hagerty and Sons, South Bend, Ind. The anti-tarnish cloth 33 allows the jewelry to be placed in the chest 10 while reducing the risk of tarnish to the jewelry items. FIG. 7 is a perspective view of the jewelry chest shown in FIG. 1 with all of the doors and pivoting trays swung shut.

In a preferred embodiment, the jewelry chest is formed of plastic and is about one foot wide, one foot high and about nine inches deep. Of course, the preferred embodiment of the chest is not limited in size and other dimensions may be used depending on the quantity of jewelry to be held. Alternatively, the chest can be made of various materials such as acrylic, polystyrene, polypropylene and wood.

Figure 8:
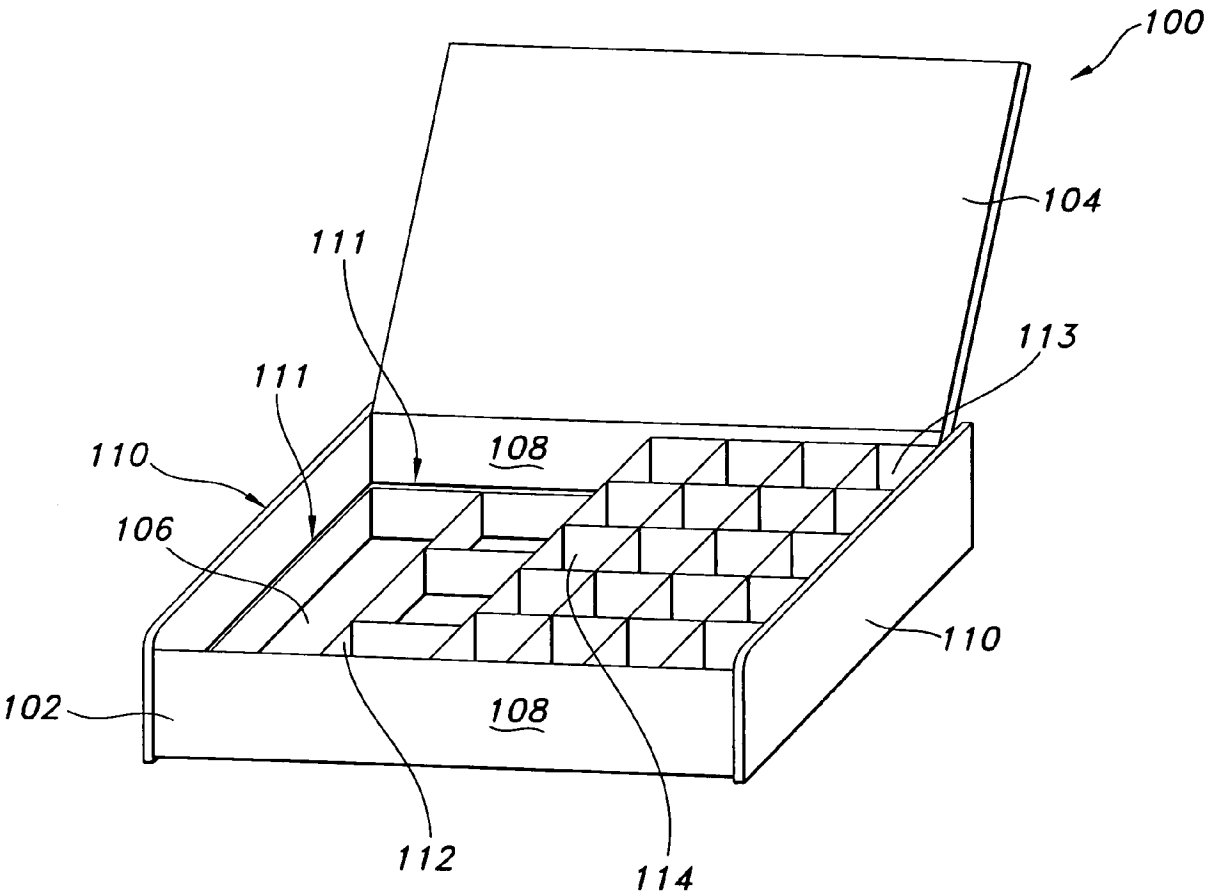
FIG. 8 is a perspective view of a jewelry box according to a preferred embodiment of the present invention.
Figure 9:
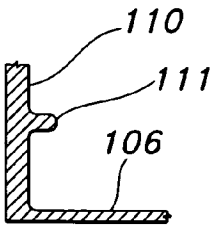
FIG. 9 is a partial cross-sectional view of the side wall of the jewelry box shown in FIG. 8 according to a preferred embodiment of the present invention.
Figure 10:
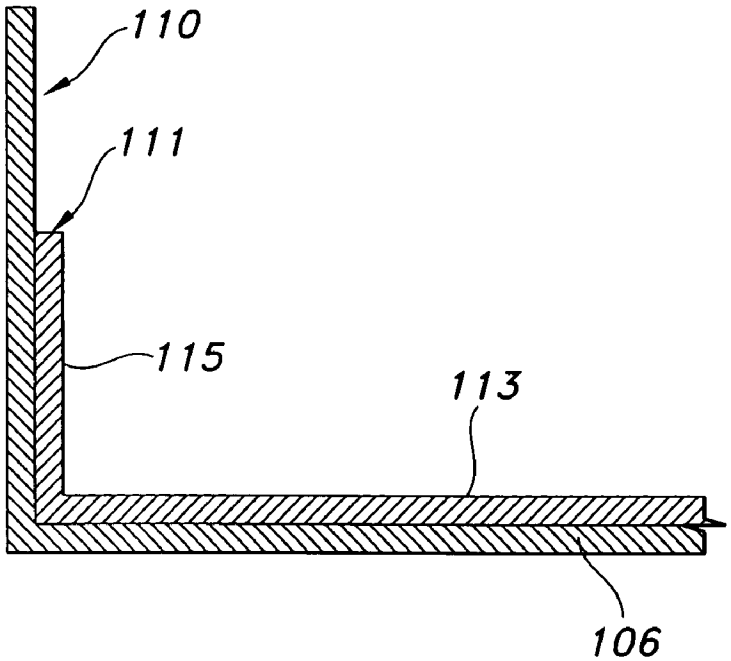
FIG. 10 is a partial cross-sectional view of the side wall of the jewelry box shown in FIG. 8 according to a preferred embodiment of the present invention.

FIG. 8 is a jewelry box 100 according to a preferred embodiment of the present invention. The jewelry box 100 includes a base 102 and a lid 104. The base is formed by a bottom 106, a front and a back side 108 and a left and a right side 110. Formed along the front and back sides 108 and left and right sides 110 is a rim 111. FIG. 9 is a partial cross-sectional view of the side wall of the jewelry box shown in FIG. 8 according to a preferred embodiment of the invention. It can be seen that the rim 111 projects from the side wall 110 and is of sufficient size and strength to hold the sliding earring tray 114. FIG. 10 is a partial cross-sectional view of the side wall of the jewelry box shown in FIG. 8 according to another preferred embodiment of the present invention. In the preferred embodiment, the rim 111 is formed by an inner box 113 located in the base 102. The inner box 113 has walls 115 that extend partially up the front, back, left and right walls 108, 110, respectively.

Located within the base 102 is a first sliding tray 112 and a top sliding tray 114. The bottom sliding tray 112 has a plurality of compartments as will be described with respect to FIG. 9. The top sliding tray 114 has a plurality of compartments 113 that are designed to hold small jewelry items such as earrings. The top sliding tray 114 is supported by the rim 111 formed along the front and back walls 108 and left and right side walls 110. The top sliding tray 114 can be pushed along the rim so that it slides over the bottom sliding tray 112. In addition the top sliding tray can be removed from the jewelry box 100 altogether.

Figure 11:
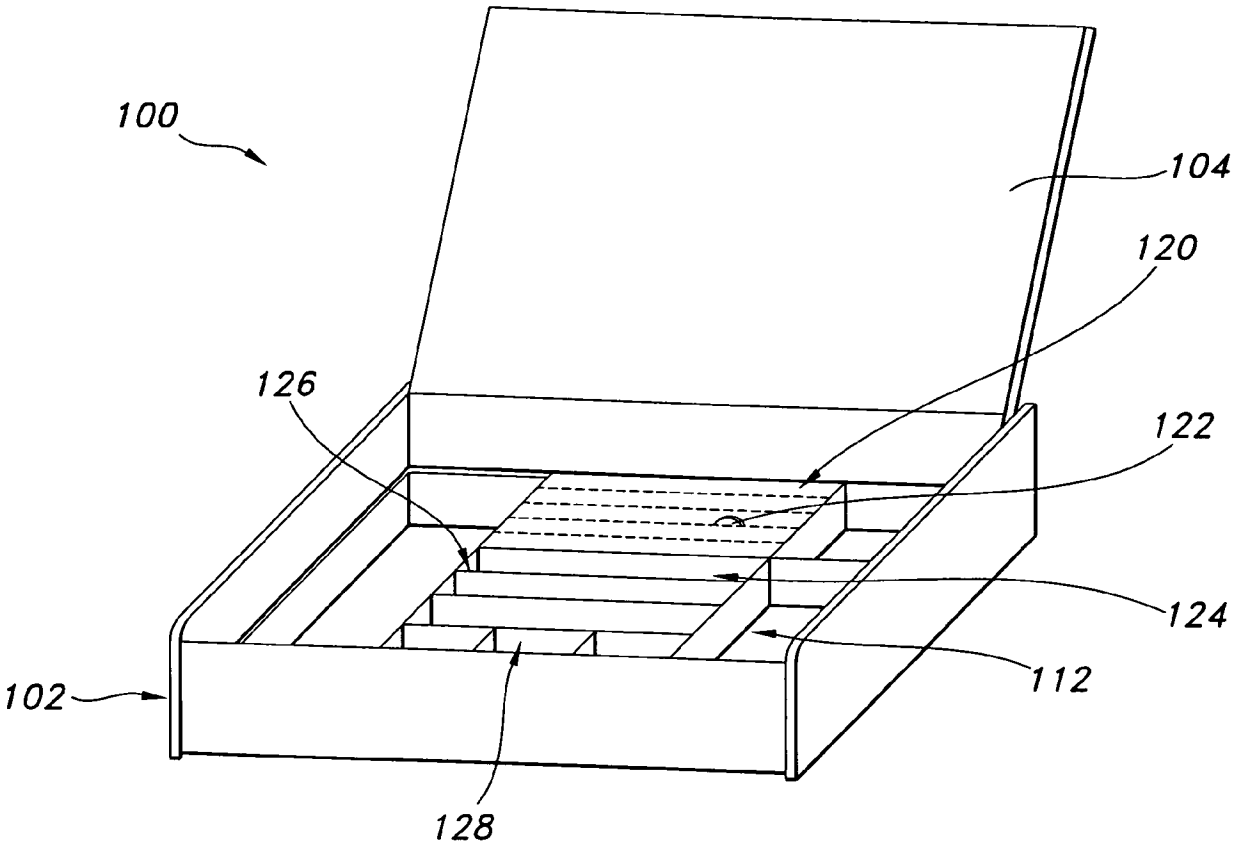
FIG. 11 is a perspective view of the jewelry box shown in FIG. 8 with the lid open and the top sliding drawer removed.
Figure 12:
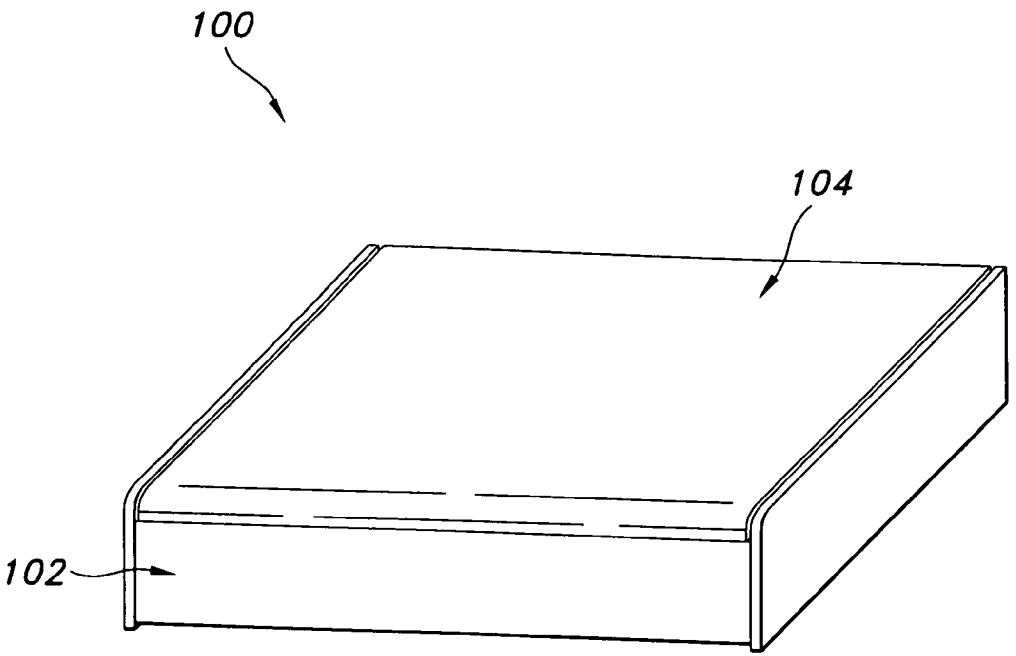
FIG. 12 is a perspective view of the jewelry box shown in FIG. 8 closed.

FIG. 10 is a perspective view of the jewelry box 100 shown in FIG. 8 with the top sliding tray 114 removed. As can be seen from this FIG., the bottom sliding tray 112 has a plurality of compartments 128 which can hold larger jewelry items such as cuff links, necklaces, etc. Next to that is a bracelet holder 124 which has a plurality of slots 126 which can accommodate bracelets therein. Located adjacent to the bracelet holder 124 is a ring holder 120. The ring holder 120 has a plurality of slots 122 which can accommodate rings therein. If the rim is formed according to FIG. 9 then, like the top sliding tray 114 shown in FIG. 8, the bottom sliding tray 112 can slide from left to right and vice versa along the bottom 106 of the base 102. If the rim is formed according to FIG. 10 then the bottom tray 112 is formed in the inner box 113 and is stationary. FIG. 11 is a perspective view of the jewelry box 100 shown in FIG. 8 with the lid 104 closed. As can be seen the jewelry box 100 has a nice sleek design which can be placed in a drawer, put on top of a dresser, incorporated into a closet organizer.

The jewelry box 100 shown in FIGS. 8–11 is preferably made of plastic but may be made of various materials such as acrylic, polystyrene, polypropylene and wood. The walls and floors of the compartments in the top and bottom sliding trays 112, 114 respectively and the lid 104 and bottom 106 of the box are preferably lined with the same anti-tarnish material that was described with respect to the jewelry chest shown in FIGS. 1–7. The jewelry box 100 in FIGS. 8–11 preferably has a width measured from the left side wall 110 to the right side wall 110 of about 14 inches. It has a depth measured from the front wall 108 to the back wall 108 of about 9 inches. The jewelry box has a height measured from the bottom 106 of the base 102 to the lid 104 of preferably 3 inches. Of course, those of ordinary skill in the art will realize that other dimensions may be used depending on the quantity of jewelry items that the box is designed to hold.

Figure 13:
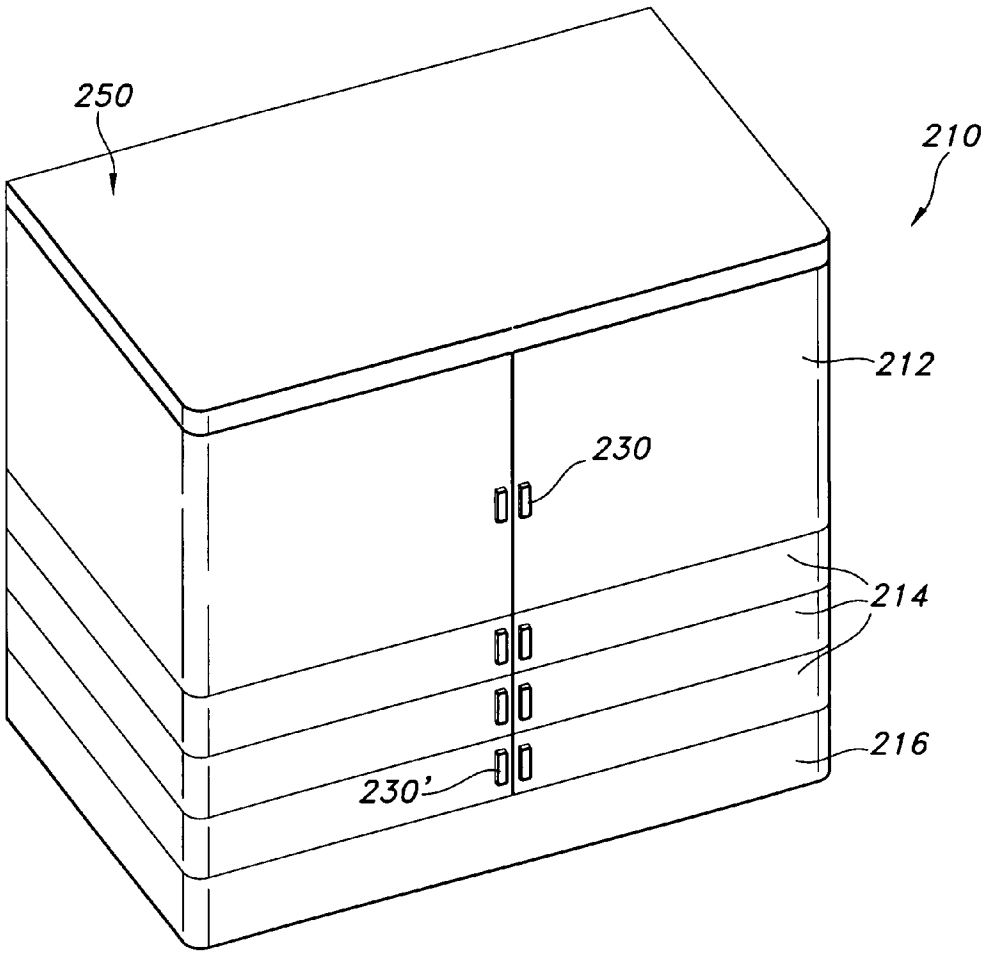
FIG. 13 is a perspective view of a jewelry chest according to another preferred embodiment of the present invention.
Figure 14:
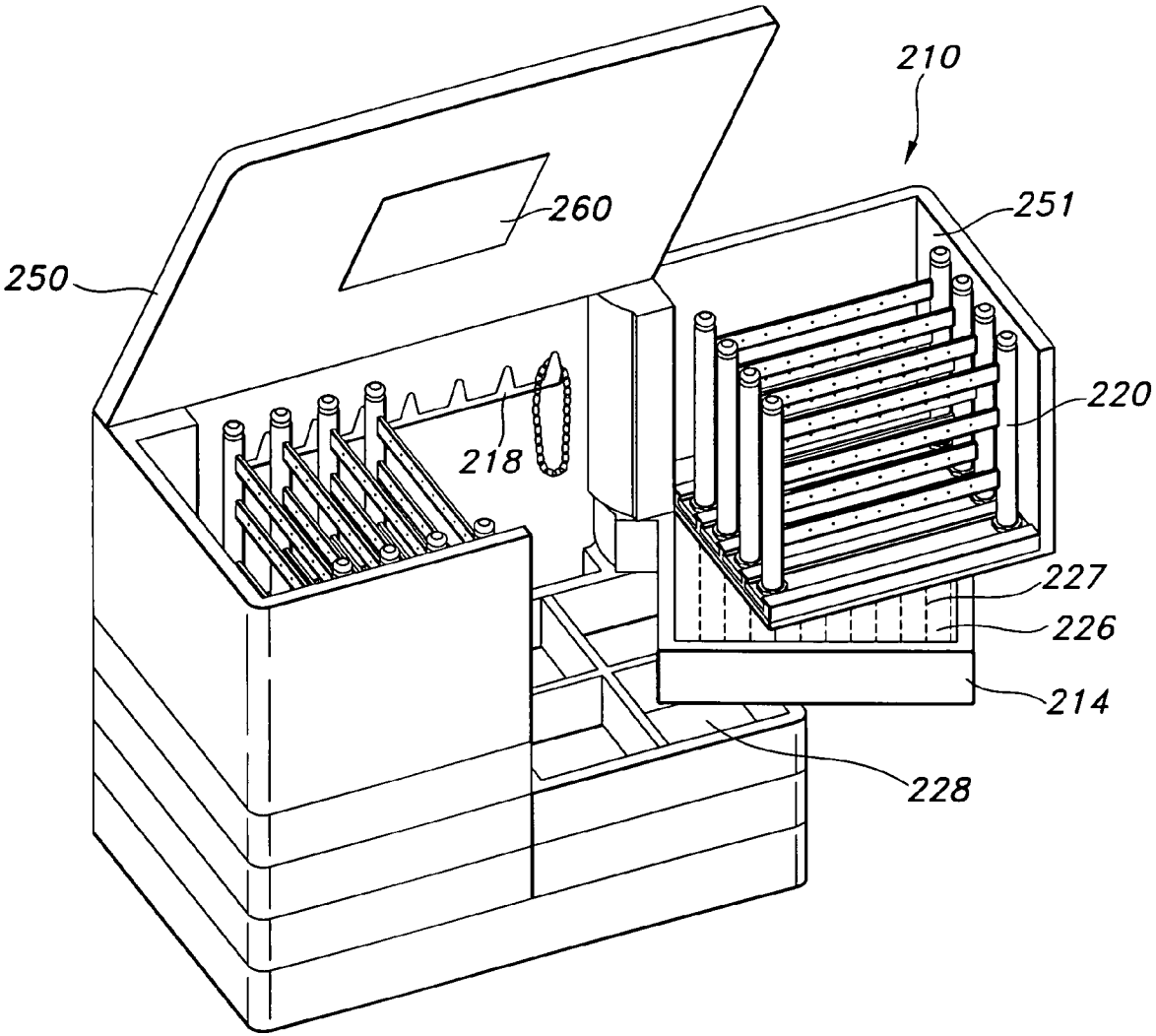
FIG. 14 is a perspective view of the jewelry chest shown in FIG. 13 closed.

FIG. 13 is a perspective view of a jewelry chest according to another preferred embodiment of the present invention. FIG. 14 is a perspective view of the jewelry chest shown in FIG. 13 closed. The jewelry chest 210 is similar to that shown in FIGS. 1–7 with the exception that it includes a pivoting lid 250. In FIG. 14 the lid 250 is shown open and in a preferred embodiment a mirror 260 is disposed on an interior surface. Although the mirror is shown as rectangular in shape it may have other shapes such as square, round or oval, for example. In addition, while cabinets 212 are shown as having a top wall 251, in another embodiment the top wall 251 is absent and when the lid 250 is pivoted open, the contents of the cabinets 212 are exposed. In a preferred embodiment, the interior surface of the lid 250 not covered with a mirror 251 if a mirror is present is lined with an anti-tarnish cloth as described above.

It should be understood that a wide range of changes and modifications can be made to the embodiment described above. It is therefore intended that the foregoing description illustrates rather than limits this invention, and that it is the following claims, including all equivalents, which define the invention.

What is claimed is:

1. A chest for the storage of jewelry, the chest comprising:

a top;

a bottom spaced from the top;

a first tray pivotally coupled to the top and bottom;

a second tray pivotally coupled to the top and bottom wherein the second tray is located underneath the first tray and the second tray is located adjacent to the first tray wherein the first tray is coupled to the top and bottom at a different point than the second tray;

a first pivoting cabinet located between the top of the chest and the first tray; and an earring stand located in the first cabinet; wherein the first cabinet has a groove formed therein and the earring stand has a base which is dimensioned to be slidably received in the groove, the earring stand having a pair of vertical supports extending from its base and a crosspiece extending between the two vertical supports.

2. The chest according to claim 1 wherein the crosspiece has a plurality of earring holes.

3. The chest according to claim 1 wherein the chest is constructed of plastic, acrylic, polystyrene, polypropylene or wood.

4. The chest according to claim 1 further comprising a rear wall coupling the top and bottom wherein the rear wall prevents the rotation of the first and second trays past the rear wall.

5. The chest according to claim 1 wherein the first tray houses divided compartments.

6. The chest according to claim 1 wherein the first tray houses a ring holder.

7. The chest according to claim 1 further comprising a first storage compartment unit that is removable placed in the first tray.

8. The chest according to claim 1 wherein the first tray is lined with antitarnish cloth.

9. A chest for the storage of jewelry, the chest comprising:

a top;

a bottom spaced from the top;

a first tray pivotally coupled to the top and bottom;

a second tray pivotally coupled to the top and bottom;

a first cabinet located between the top and the first tray; and an earring stand located in the first cabinet; wherein the first cabinet has a groove formed therein and the earring stand has a base which is dimensioned to be slidably received in the groove, the earring stand having a pair of vertical supports extending from its base and a crosspiece extending between the two vertical supports.

10. The chest according to claim 9 wherein the first cabinet is a pivoting cabinet.

11. The chest according to claim 9 wherein the crosspiece has a plurality of earring holes.

12. The chest according to claim 9 wherein the chest is constructed of plastic, acrylic, polystyrene, polypropylene or wood.

13. The chest according to claim 9 wherein the second tray is located underneath the first tray.

14. The chest according to claim 13 wherein the second tray is located adjacent to the first tray wherein the first tray is coupled to the top and bottom at a different point than the second tray.

15. The chest according to claim 9 further comprising a rear wall coupling the top and bottom wherein the rear wall prevents the rotation of the first and second trays past the rear wall.

16. The chest according to claim 9 wherein the first tray houses divided compartments.

17. The chest according to claim 9 wherein the first tray houses a ring holder.

18. The chest according to claim 9 further comprising a first storage compartment unit that is removable placed in the first tray.

19. The chest according to claim 9 wherein the first tray is lined with antitarnish cloth.

* * * * *